US005633041A

United States Patent [19]

Arrington

[11] Patent Number: 5,633,041

[45] Date of Patent: May 27, 1997

[54] METHOD OF MAKING PHOTOGRAPHIC PAPER

[75] Inventor: Eric E. Arrington, Farmington, N.Y.

[73] Assignee: Eastman Kodak Company, Rochester, N.Y.

[21] Appl. No.: 644,558

[22] Filed: May 10, 1996

Related U.S. Application Data

[60] Provisional application No. 60/005,202 Oct. 11, 1995.

[51] Int. Cl. [6] ..... B05D 3/00

[52] U.S. Cl. ..... 427/361; 427/366; 427/370; 427/374.5; 427/391; 427/395; 427/420; 118/101; 118/118; 118/407; 118/DIG. 4; 156/244.11; 156/244.22; 156/244.24; 156/244.26; 156/244.27

[58] Field of Search ..... 118/101, 118, 118/407, DIG. 4; 156/244.11, 244.22, 244.24, 244.26, 244.27; 427/359, 361, 362, 365, 366, 369, 370, 371, 374.1, 374.4, 374.5, 391, 395, 420

[56] References Cited

U.S. PATENT DOCUMENTS 2,407,335 9/1946 Wickwire, Jr. .
2,714,571 8/1955 Irion et al. .
2,753,275 7/1956 Wiles et al. .
3,192,893 7/1965 Bauer et al. .
5,245,920 9/1993 Hess ..... 100/38

FOREIGN PATENT DOCUMENTS 685633 5/1964 Canada .
887737 1/1962 United Kingdom .

*Primary Examiner*—Shrive Beck
*Assistant Examiner*—Erma Cameron
*Attorney, Agent, or Firm*—Robert A. Gerlach

[57] ABSTRACT

The invention provides a method of making thermoplastic resin-coated paper which comprises coating a paper sheet with a liquid thermoplastic resin, passing the thermoplastic resin-coated paper sheet through a nip of a pressure roll and a thermally conductive medium to form a resin-medium interface, heating the interface to a temperature of from 35° C. to 350° C. for a nip time period of from 0.002 to 10 seconds and a pressure of from 17,500 to 1,750,000 Pa-m, cooling the interface to a temperature of −73° to 32° C. for a cooling time period of from 0.001 to 100 seconds, and separating the thermoplastic resin-coated paper from the medium.

10 Claims, 1 Drawing Sheet

METHOD OF MAKING PHOTOGRAPHIC PAPER

CROSS REFERENCE TO RELATED APPLICATION

Reference is made to and priority claimed from U.S. application Ser. No. 60/005,202, filed 11 Oct. 1995, entitled METHOD OF MAKING PHOTOGRAPHIC PAPER.

FIELD OF THE INVENTION

This invention relates to a process for producing thermoplastic coated photographic paper by extrusion coating, and more particularly to a process for producing thermoplastic coated paper at increased speeds, and lower thermoplastic melt temperatures.

BACKGROUND OF THE INVENTION

Photographic paper is coated with a polyolefin layer or layers preferably by extrusion from a hot melt as is known in the art.

The polyolefin can be extruded with a wide temperature range, i.e., 150° C.–350° C. through a coat hanger die into the nip formed by a metallic chill roll and an elastomeric pressure roll. The pressure roll causes a nip pressure of typically 17,500 Pa-m to 175,000 Pa-m, where the nip is defined as the point where pressure is applied, to the point where pressure is relieved, which forces the polyolefin into the interstices of the porous paper forming a mechanically interlocked polymer/paper composite.

The coated paper is then cooled on the chill roll which is operated at a temperature of between 4° C. to about 32° C. and conveyed to the stripping point of the chill roll where the paper is removed by tension, and wound into a roll or conveyed to the next coating operation.

In the current configuration used in the industry, the temperature of the chill roll must be warm enough to allow the polymer to penetrate the pores of the paper in the nip. If the chill roll is too cold, the polymer will be cooled below its melting point before it has an opportunity to penetrate the pores of the paper, and poor bonding will result. This will deleteriously affect product quality, often resulting in the penetration of photographic processing chemicals between the paper/thermoplastic interface which will result in edge stains on the finished photographs.

Alternatively, if the chill roll is too warm, the thermoplastic will act as an adhesive, and will not be stripped off the chill roll properly, often resulting in a web break which decreases productivity. Thus the range of chill roll temperatures is dictated by the conflicting needs of good bonding and high productivity. In order to increase productivity and get good bond, it is common practice to increase the polymer melt temperature, which improves the bond. However, an increase in the polymer melt temperature will often result in curtain instability, and cause the polymer to degrade in a chain scission reaction (Billmeyer, Textbook of Polymer Science, Wiley Interscience publication, 1984, pp 141–143). This results in impurities and a general reduction in the polymer physical properties.

BACKGROUND OF THE INVENTION

As a result, there is a need for a process which provides both good bond and good productivity without the need to heat the polymer melt to high temperatures.

SUMMARY OF THE INVENTION

The invention provides a method of making thermoplastic resin-coated paper which comprises coating a paper sheet with a liquid thermoplastic resin, passing the thermoplastic resin-coated paper sheet through a nip of a pressure roll and a thermally conductive medium to form a resin-medium interface, heating the interface to a temperature of from 35° C. to 350° C. for a nip time period of from 0.002 to 10 seconds and a pressure of from 17,500 to 1,750,000 Pa-m, cooling the interface to a temperature of −73° to 32° C. for a cooling time period of from 0.001 to 100 seconds, and separating the thermoplastic resin-coated paper from the medium.

ADVANTAGEOUS EFFECT OF THE INVENTION

The described invention allows strong bonding through the use of high nip temperature, sustained by the heated surface which allows the thermoplastic to penetrate the pores of the paper. The heated surface may be textured. After the paper/polymer is well bonded, the invention also allows for a cooling of the textured surface, permitting the composite to be stripped off the surface without being torn or delaminated.

DESCRIPTION OF PREFERRED EMBODIMENTS

Figure 1:
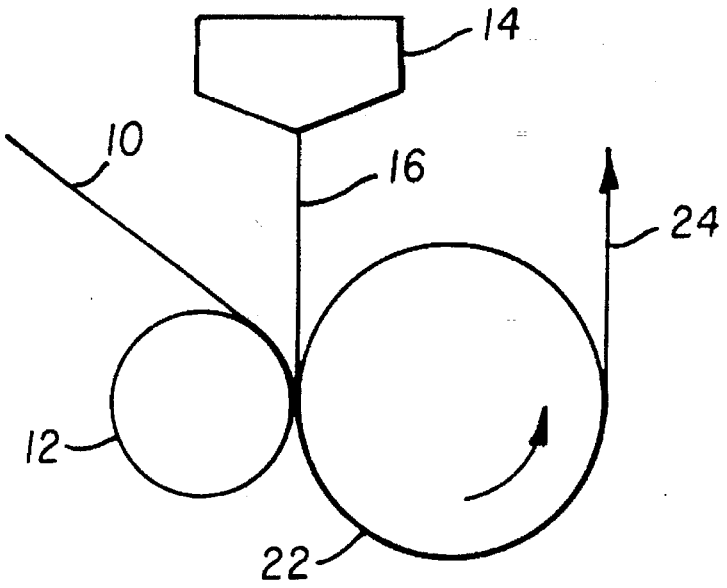
FIG. 1 is a diagrammatic view of an apparatus in accordance with present day technology.

In the preparation of a thermoplastic coated paper for photographic paper base in accordance with this invention, a thermoplastic resin is prepared consisting of any coatable polyolefin material known in the photographic art. Representative of these materials are polyethylene, polypropylene, polystyrene, polybutylene, and copolymers thereof. Polyethylene of low, medium or high density is preferred. The polyolefin can be copolymerized with one or more copolymers including polyesters, such as, polyethylene terephthalate, polyethylene naphthalate, polysulfones, polyurethane's, polyvinyls, polycarbonates, cellulose esters, such as cellulose acetate and cellulose propionate, and polyacrylates. Specific examples of copolymerizable monomers include vinyl stearate, vinyl acetate, acrylic acid, methylacrylate, ethylacrylate, acrylamide, methacrylic acid, methylmethacrylate, ethylmethacrylate, methacrylamide, butadiene, isoprene, and vinyl chloride. Preferred polyolefins are film forming and adhesive to paper. Polyethylene having a density in the range of from about 0.91 grams/cm3 to about 0.98 grams/cm3 is most preferred. If the polyolefin is to be applied to the side of the paper whereupon the photographic emulsion will be applied, then additions to the polyolefins, may include a suitable optical brightener such as those described in Research Disclosure Issue N. 308, December 1989, Publication 308119, Paragraph V, Page 998, in an amount of from about 0.001 to about 0.25 percent by weight based on the total weight of the polyolefin coating, including any white pigment present, with 0.01 to about 0.1 percent being the most preferred. Any suitable white pigment may be incorporated in the polyolefin layer, such as, for example, titanium dioxide, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The pigment is used in any form that is conveniently dispersed within the polyolefin. The preferred pigment is titanium dioxide in the anatase crystalline form. Preferably, the white pigment should be employed in the range of from about 3 to about 35 percent by weight, based on the total weight of the polyolefin coating. Anatase titanium dioxide at from about 5 to about 20 percent is most preferred.

In addition to the brightener mixture and the white pigment, the polyolefin coating can contain, if desired, a variety of additives including antioxidants such as 4,4'-butylidene-bis(6-tert-butyl-meta-cresol), di-lauryl-3,3'-thiodipropionate, N-butylated-p-aminophenol, 2,6-di-tert-butyl-p-cresol, 2,2-di-tert-butyl-4-methyl-phenol, N,N-disalicylidene-1,2-diaminopropane, tetra(2,4-tert-butylphenyl)-4,4'-diphenyl diphosphonite, octadecyl 3-(3',5'-di-tert-butyl-4'-hydroxyphenyl propionate), combinations of the above, and the like; heat stabilizers, such as higher aliphatic acid metal salts such as magnesium stearate, calcium stearate, zinc stearate, aluminum stearate, calcium stearate, zinc stearate, aluminum stearate, calcium palmirate, sodium palmirate, zironium octylate, sodium laurate, and salts of benzoic acid such as sodium benzoate, calcium benzoate, magnesium benzoate and zinc benzoate; calcium stearate of concentrations between 0.1 and 1.0% with 0.4–0.6% being most preferred. Addition of antistatic agents; lubricants; dyes; and the like, can also be added as is well known to those skilled in the art. Additionally, emulsion side resins can contain one or more pigments, such as the blue, violet or magenta pigments described in U.S. Pat. No. 3,501,298, or pigments such as barium sulfate, colloidal silica, calcium carbonate and the like, with the preferred colorant combination consisting of cobalt aluminate and quinacridone, present in concentrations of between 0.02 to 0.5% and 0.0005 to 0.05% respectively, with the most preferred concentrations being from 0.1 to 0.2% and 0.001 to 0.003% respectively.

The paper base material employed in accordance with the invention can be any paper base material which has heretofore been considered useful for a photographic support. The weight and thickness of the support can be varied depending on the intended use. A preferred weight range is from about 20 g/m2 to about 500 g/m2, with about 100–200 g/m2 being the most preferred. Preferred thickness (those corresponding to commercial grade photographic paper) are from about 20 μm to about 500 μm with the most preferred thickness being from 100–200 μm. It is preferred to use a paper base material calendered to a smooth surface. The paper base material can be made from any suitable paper stock preferably comprising hard or softwood. Either bleached or unbleached pulp can be utilized as desired. The paper base material can also be prepared from partially esterified cellulose fibers or from a blend of wood cellulose and a suitable synthetic fiber such as a blend of wood cellulose and polyethylene fiber.

As is known to those skilled in the art, the paper base material can contain, if desired, agents to increase the strength of the paper such as wet strength resins, e.g., the amino-aldehyde or polyamide-epichlorohydrin resins, and dry strength agents, e.g., starches, including both ordinary starch and cationic starch, or polyacrylamide resins. In a preferred embodiment of this invention, the amino-aldehyde or polyamide-epichlorohydrin and polyacrylamide resins are used in combination as described in U.S. Pat. No. 3,592,731. Other conventional additives include water soluble gums, e.g., cellulose ethers such as carboxymethyl cellulose, sizing agents, e.g., alkyl ketene dimers, sodium stearate which is precipitated on the pulp fibers with a polyvalent metal salt such as alum, aluminum chloride or aluminum salts.

In FIG. 1, which represents the current state of the art of making resin coated paper, paper 10, treated with corona discharge, flame treatment, chemical treatment and the like (not shown), is delivered in a continuous sheet from a supply roll (not shown) to a nip formed of pressure roll 12 and chill roll 22. Liquid thermoplastic 16 is extruded from extrusion die 14 onto the paper 10 at the nip, follows a path around chill roll 22 and the coated paper 24 is removed from the chill roll 22 and wound on a suitable take-up roll (not shown). The liquid thermoplastic 16, prior to entering application to the paper, may be treated with ozone, UV radiation and the like.

Figure 2:
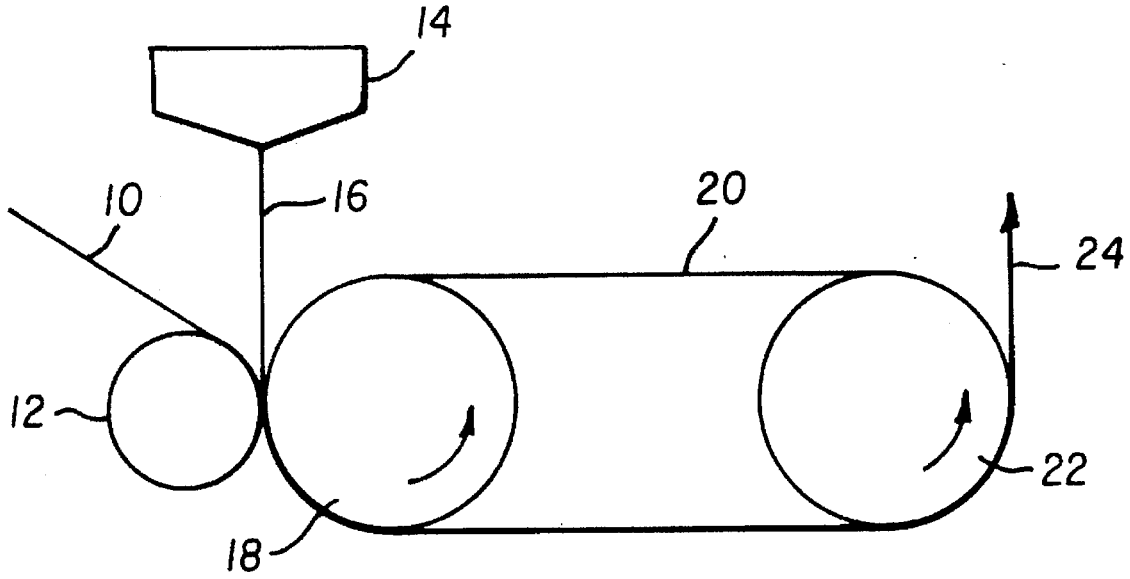
FIG. 2 is a diagrammatic view of an apparatus for carrying out the method of this invention.

Referring to FIG. 2, the paper 10 is preferably treated with a corona discharge or other treatment as mentioned above (not shown) to improve the adhesion of the polyolefin to the paper support as described in U.S. Pat. No. 3,411,908. The paper 10 is delivered in a continuous sheet from a supply roll (not shown) to a nip formed by pressure roll 12 and metallic band 20 operating in conjunction with heated roll 18. Liquid thermoplastic 16 is extruded from a suitable die 14 onto the paper 10 at the nip. The liquid thermoplastic may be treated as above. Metallic textured band 20 follows a continuous path around heated roll 18 and chill roll 22. The paper 10 after coating and passage through the heated nip is heated for a prerequisite time period and then chilled by the action of chill roll 22 operating on band 20. The coated paper 24 is separated from the band 20 and wound on a suitable take-up roll (not shown).

As indicated above, the polymer is melted and extruded into the nip formed by the elastomeric pressure roll 12 and the moving textured surface formed by heated roll 18 and band 20. The most preferred polymer is polyethylene, and the preferred extrusion temperature is from 150° C. to 350° C. A temperature of from 280° C. to 320° C. is most preferred.

The texture of the band 20 corresponds to the glossy, matte, etc., finishes of chill rolls which are normally used in the art. The heated roll 18 controls the surface temperature of the textured band 20 so that the temperature of 35° C. to 350° C., with a preferred temperature being from 50° C. to 125° C., is maintained. Most preferably, the temperature for polyethylene is maintained at from 60° C. to 125° C. The nip width is such that the residence time in the nip is between 0.002 seconds and 10 seconds, preferably 0.002 to 0.01 seconds and most preferably, 0.002 to 0.005 seconds. The pressure in the nip is about 17,500 Pa-m to 1,750,000 Pa-m, with the preferred pressure being from 100,000 Pa-m to 200,000 Pa-m. The coated paper 24 emerges from the nip with good bond, and the temperature of the textured surface of the band 20 is lowered to a temperature of from −73° C. to 32° C., or a preferred temperature of about 4° C. to 18° C. for a time period of about 0.001 seconds to 100 seconds, with the preferred time period being from about 0.1 second to 1 second. The coated paper 24 is then stripped off the surface of the band 20 without damage to the paper.

While the figure illustrates one manifestation of equipment which might be used in the method, it is to be understood that other pieces of equipment, such as a liquid fed roll with a commutator to separate hot and cold liquids could also be used and in no way limits the scope of the invention.

The invention will be further illustrated by the following examples:

EXAMPLE 1 (CONTROL)

A polyethylene resin consisting of 99.9% polyethylene of density 0.945 g/cm3 and 0.1% 4,4'-butylidene-bis(6-tert-butyl-meta-cresol) is melted in a single screw extruder and is forced through a coat hanger die at a temperature of 316° C., the flow rate being such that the coated thickness of the polyethylene is 25 μm. The resin joins the paper in a nip formed by an elastomeric roll and a chill roll as shown in FIG. 1, for a time period of 0.0046 seconds, under a pressure of 175,000 Pa-m. The surface of the chill roll is 10° C. The coated paper is then conveyed out of the nip and and is stripped off the chill roll.

EXAMPLE 2

A polyethylene resin consisting of 99.9% polyethylene of density 0.945 g/cm3 and 0.1% 4,4'-butylidene-bis(6-tert-butyl-meta-cresol) is melted in a single screw extruder and is forced through a coat hanger die at a temperature of 316° C., the flow rate being such that the coated thickness of the polyethylene is 25 μm. The resin joins the paper in a nip formed by an elastomeric roll and a textured surface as shown in FIG. 2, for a time period of 0.0036 seconds, under a pressure of 175,000 Pa-m. The temperature of the textured surface is 93° C. The coated paper is then conveyed out of the nip with good bond, and the temperature of the textured surface temperature is cooled at the chill roll to 7° C. for 0.158 seconds. The coated paper can be stripped off the textured surface without damage, and a speed increase of 28% is achieved over that of Example 1 (control).

EXAMPLE 3

Example 2 is repeated, except the initial temperature of the textured surface is 121° C. Because of the increase in temperature, less residence time in the nip is required to achieve good bond, so the speed of the process can be increased such that the residence time is reduced to 0.0034 seconds. The coated paper can be stripped off the textured surface without damage, and a speed increase of 35% over Example 1 (control) is achieved.

EXAMPLE 4

Example 2 is repeated, except the temperature of the melt is 288° C., which results in reduced degradation of the polyethylene. The temperature of the textured surface is 66° C. Because of the increase in surface temperature, less residence time in the nip is required to achieve good bond, so the speed of the process is increased such that the residence time is 0.0044 seconds. The coated paper can be stripped off the textured surface without damage, and a speed increase of 5% over Example 1 (control) is achieved.

EXAMPLE 5

Example 2 is repeated, except the temperature of the melt is 343° C., which results in increased degradation of the polymer, but higher speeds. Because the resin is hotter, shorter residence time in the nip is required to achieve good bond, and the machine speed can be increased such that the nip residence time is 0.0038 seconds. The coated paper is stripped off the textured surface without damage.

EXAMPLE 6

Example 5 is repeated, except the initial temperature of the textured surface is 93° C. Because of the increase in surface temperature, less residence time in the nip is required to achieve good bond, so the speed of the process can be increased such that the residence time is 0.0031 seconds. The coated paper can be stripped off the textured surface without damage, and a speed increase of 23% over Example 5 is achieved.

EXAMPLE 7

Example 5 is repeated, except the initial temperature of the textured surface is 121° C. Because of the increase in surface temperature, less residence time in the nip is required to achieve good bond, so the speed of the process is increased and the residence time is 0.0028 seconds. The coated paper can be stripped off the textured surface without damage, and a speed increase of 36% over example 5 is achieved.

What is claimed is:

1. A method of making thermoplastic resin-coated paper which comprises coating a paper sheet with a liquid thermoplastic resin, passing the thermoplastic resin-coated paper sheet through a nip of a pressure roll and a thermally conductive medium to form a resin-medium interface, heating the interface to a temperature of from 35° C. to 350° C. for a nip time period of from 0.002 to 10 seconds and a pressure of from 17,500 to 1,750,000 Pa-m, cooling the interface to a temperature of −73° to 32° C. for a cooling time period of from 0.001 to 100 seconds, and separating the thermoplastic resin-coated paper from the medium.

2. The method of claim 1 wherein the nip time period is from 0.002 to 0.01 seconds.

3. The method of claim 1 wherein the nip time period is from 0.002 to 0.005 seconds.

4. The method of claim 1 wherein the interface is heated to from 50° to 125° C.

5. The method of claim 1 wherein the interface is heated to from 60° to 125° C.

6. The method of claim 1 wherein the pressure is from 100,000 to 200,000 Pa-m.

7. The method of claim 1 wherein the cooling time period is from 0.1 to 1 seconds.

8. The method of claim 1 wherein the cooling temperature is from 4° C. to 18° C.

9. The method of claim 1 wherein the thermoplastic resin is selected from the group consisting of polyethylene, polypropylene, polystyrene, polybutylene, polyethylene terephthalate, polyethylene naphthalate, polysulfones, polyurethanes, polyvinyls, polycarbonates, cellulose esters, polyvinyl stearate, polyvinyl acetate, polyacrylic acid, polymethylacrylate, polyethylacrylate, polyacrylamide, polymethacrylic acid, polymethylmethacrylate, polyethylmethacrylate, polymethacrylamide, polybutadiene, polyisoprene, and polyvinyl chloride.

10. The method of claim 1 wherein the thermoplastic resin is polyethylene.

* * * * *